US006334302B1

(12) United States Patent
Chang-Diaz

(10) Patent No.: US 6,334,302 B1
(45) Date of Patent: Jan. 1, 2002

(54) VARIABLE SPECIFIC IMPULSE MAGNETOPLASMA ROCKET ENGINE

(75) Inventor: Franklin R. Chang-Diaz, Seabrook, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/351,152

(22) Filed: Jun. 28, 1999

(51) Int. Cl.[7] ..... H05B 1/00
(52) U.S. Cl. ..... 60/203.1
(58) Field of Search ..... 60/200.1, 203.1, 60/204

(56) References Cited

U.S. PATENT DOCUMENTS

| | | | | |
|---|---|---|---|---|
| 3,626,341 A | * | 12/1971 | Dao | 335/216 |
| 4,548,033 A | * | 10/1985 | Cann | 60/203.1 |
| 4,815,279 A | | 3/1989 | Chang | 60/202 |
| 4,893,470 A | | 1/1990 | Chang | 60/204 |
| 5,052,638 A | | 10/1991 | Minovitch | 244/53 R |
| 5,241,244 A | * | 8/1993 | Cirri | 315/111.41 |
| 5,444,973 A | | 8/1995 | Limerick et al. | 60/204 |
| 5,536,914 A | | 7/1996 | Pellectier et al. | 219/121.48 |
| 5,537,004 A | | 7/1996 | Imahashi et al. | 315/111.21 |
| 5,565,118 A | | 10/1996 | Asquith et al. | 219/121.57 |
| 5,581,155 A | | 12/1996 | Morozov et al. | 315/111.21 |
| 5,838,120 A | | 11/1998 | Semenkin et al. | 315/505 |
| 5,841,237 A | * | 11/1998 | Alton | 315/111.81 |
| 5,845,480 A | | 12/1998 | DeFreitas et al. | 60/39.06 |
| 5,845,880 A | | 12/1998 | Petrosov et al. | 244/169 |

* cited by examiner

*Primary Examiner*—Charles G. Freay
*Assistant Examiner*—William H Rodriguez
(74) *Attorney, Agent, or Firm*—Hardie R. Barr

(57) ABSTRACT

An engine is disclosed, including a controllable output plasma generator, a controllable heater for selectably raising a temperature of the plasma connected to an outlet of the plasma generator, and a nozzle connected to an outlet of the heater, through which heated plasma is discharged to provide thrust. In one embodiment, the source of plasma is a helicon generator. In one embodiment, the heater is an ion cyclotron resonator. In one embodiment, the nozzle is a radially diverging magnetic field disposed on a discharge side of the heater so that helically travelling particles in the heater exit the heater at high axial velocity. A particular embodiment includes control circuits for selectably directing a portion of radio frequency power from an RF generator to the helicon generator and to the cyclotron resonator so that the thrust output and the specific impulse of the engine can be selectively controlled. A method of propelling a vehicle is also disclosed. The method includes generating a plasma, heating said plasma, and discharging the heated plasma through a nozzle. In one embodiment, the nozzle is a diverging magnetic field. In this embodiment, the heating is performed by applying a radio frequency electro magnetic field to the plasma at the ion cyclotron frequency in an axially polarized DC magnetic field.

43 Claims, 2 Drawing Sheets

Monte Carlo particle trajectories

VARIABLE SPECIFIC IMPULSE MAGNETOPLASMA ROCKET ENGINE

ORIGIN OF THE INVENTION

The invention described herein was made by employee(s) of the United States Government and may be manufactured and used by or for the Government of the United States of America for governmental purposes without the payment of any royalties thereon or therefor.

BACKGROUND OF THE INVENTION

1. Field of the Invention

This invention relates generally to the field of rocket propulsion engines. More specifically, the invention relates to rocket engines which provide thrust by discharging ionized particles in a selected direction to provide motive power for a vehicle.

2. Description of the Related Art

Engines which generate thrust by discharging ionized gas (plasma) from the engine are known in the art. U.S. Pat. No. 5,241,244 issued to Cirri, for example, describes one such engine. The engine disclosed in the Cirri '244 patent generates plasma by imparting an electromagnetic field to neutral gas injected into an ionization chamber. Free electrons in the chamber are contained in the discharge chamber and are excited by imparting an electromagnetic field generated by a radio frequency generator operating at frequencies near the ionization resonance frequency. Excited electrons strike gas atoms inside the chamber, causing the gas atoms to be ionized. A grid at the exhaust end of the discharge chamber is electrically charged to attract the ions, causing them to leave the discharge chamber through the grid at high velocity. The discharging ions create the thrust exerted by the engine.

Another type of plasma discharge engine is known as a Hall effect plasma thruster. One type of Hall effect plasma thruster is described, for example, in U.S. Pat. No. 5,845,880 issued to Petrosov et al. The thruster in the Petrosov et al '880 patent includes a chamber into which neutral gas such as xenon is injected. Electrons are emitted from a cathode proximate the discharge end of the thruster, and are accelerated toward the other end of the chamber by an anode onto which a high voltage is impressed. A magnetic field imposed on the chamber causes the electrons to move in a substantially helical path towards the anode, picking up speed as they travel. As the electrons come near the anode they collide with molecules of the injected gas, causing it to be ionized. Electrons tend to collect in a "cloud" near the exhaust end of the engine due to the magnetic field. Positively charged ionized gas atoms are electrostatically attracted to the electron cloud and exit the thruster at high speed. The magnetic field has much less effect on the path taken by the discharged ions because they are much more massive than electrons, and so the ions leave the thruster in a substantially straight path.

U.S. Pat. Nos. 4,815,279 and 4,893,470 issued to Chang describe another type of plasma discharge engine. The engine described in these patents includes an electrostatic plasma generator, such as a Marshall gun. Plasma from the generator is confined by a series of magnets and is directed to a discharge nozzle. The discharge nozzle is generally cone shaped. Contact between the plasma and the nozzle material is reduced by insulating the nozzle with neutral gas injected near the interior surface of the nozzle, and by focusing the plasma discharge using focusing magnets positioned near the nozzle inlet. The thrust developed by the engine described in these patents can be adjusted by varying the amount of neutral gas injected into the nozzle, thereby varying the mass flow through the nozzle which is directly related to the associated thrust.

One limitation of plasma discharge engines known in the art is that the specific impulse (thrust per unit mass of exhaust) of such engines cannot be easily controlled. Generally only the thrust can be directly controlled. For certain types of journeys, such as interplanetary travel, it would be desirable to have an engine which can operate at low thrust and very high specific impulse, so that high velocities, and perhaps even artificial gravity, can be developed during the journey. However, such engines would preferably have the capacity also to develop very high thrust when needed, such as during escape from planetary orbit, or reentry to orbit or planetary atmosphere.

Generally speaking, prior art plasma discharge type engines impart high discharge velocity to the plasma by imposing an electrostatic field to the plasma. The positively charged gas ions are caused to leave the engine at high velocity by being attracted to a negatively charged cathode, while the electrons remain behind. Necessarily, therefore, plasma discharge engines known in the art require an electrostatic neutralizer for the discharging ions so that electrostatic charge will not build up as a result of discharging only the positively charged ions from the engine.

SUMMARY OF THE INVENTION

An engine according to the invention comprises a controllable output plasma generator, a controllable heater for selectably raising the temperature of the plasma connected to an outlet of the plasma generator, and a nozzle connected to an outlet of the heater through which heated plasma is discharged to provide thrust. In one embodiment of the engine the plasma generator is a helicon generator. In one embodiment of the engine, the heater is an ion cyclotron resonator. In one embodiment of the engine, the nozzle comprises a radially diverging magnetic field disposed on the discharge end of the heater. A particular embodiment of the invention includes control circuits for selectably directing a selected portion of a total amount of available radio frequency power from an RF generator to the helicon generator, the remainder of the RF power going to the ion cyclotron resonator, so that the thrust output and the specific impulse of the engine can be selectably controlled.

In a particular embodiment of the engine, the plasma in the heater can be selectably recycled through the heater to further increase its temperature by including a selectably operable choke at the discharge end of the heater. In this embodiment, the choke consists of an axially polarized, variable amplitude magnetic mirror.

In still another embodiment of the engine, separation of the discharging plasma from the diverging magnetic field is improved by imparting an alternating magnetic field to the discharging plasma to "strip" it from the diverging magnetic field.

A method for propelling a vehicle according to the invention comprises generating a plasma, heating the plasma, and discharging the heated plasma through a nozzle. In one embodiment of the method, the generating is performed by a helicon generator. In one embodiment of the method, the heating is performed by an ion cyclotron resonator. In one embodiment of the method, the discharging is performed by exhausting the heated plasma through a radially diverging magnetic field disposed at one end of a chamber in which the heating takes place.

Another aspect of the invention is a method for adjusting an attitude of a vehicle, for example an outer space travelling vehicle. This aspect of the invention includes generating a plasma, heating the plasma, discharging the heated plasma through a nozzle, and directing a selected fraction of a total electrical power on the vehicle to the plasma generating, the remainder of the total electrical power being directed to the plasma heating. Selective power direction enables selectively varying a thrust and a specific impulse of propulsion. In one example, large and/or rapid attitude changes can be effected, where required, by selecting high thrust. For ultra precise pointing, where very precise attitude changes or attitude maintenance are required, high specific impulse can be selected.

DETAILED DESCRIPTION

Figure 1:
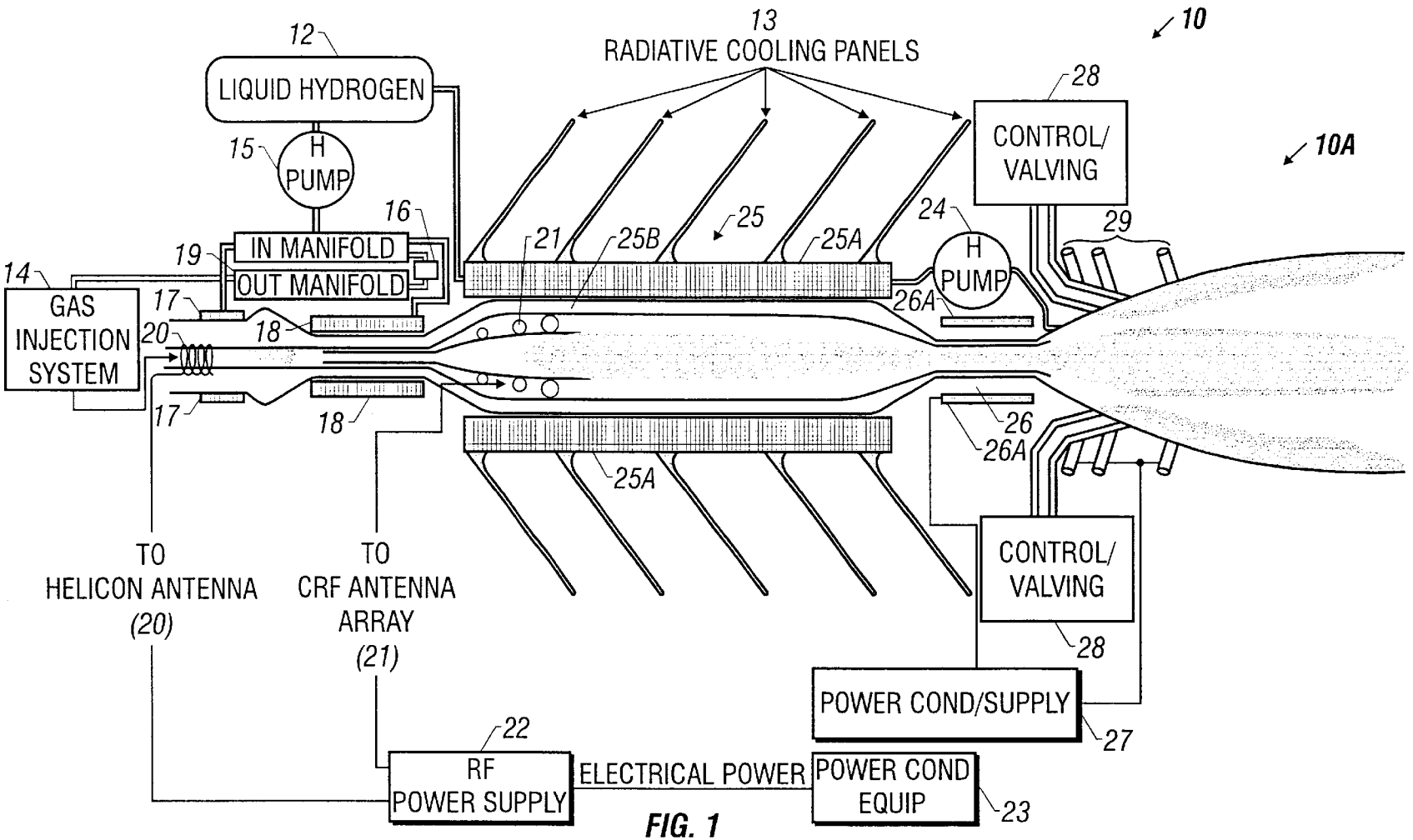
FIG. 1 shows a schematic diagram of one embodiment of the engine of the invention.

One embodiment of the invention is shown schematically in FIG. 1. A rocket engine 10 includes an ionizable gas source 12, which in this embodiment can be liquid hydrogen stored in an appropriate tank. Other ionizable gases such as methane or ammonia can be used for the engine 10 of this invention. Although this embodiment of the engine 10 includes a tank for storing ionizable gas in liquid form, it should be understood that ionizable gas can be stored in any convenient form, including production from a chemical reaction carried on near the engine 10.

The ionizable gas, if stored in liquid form as in this embodiment, can be moved from the tank 12 by an appropriate pump 15 through a gas/liquid separator 16. One advantage of using liquid hydrogen as in this embodiment of the invention is that the liquid hydrogen leaving the separator 16 can be used to cool superconducting electromagnets such as shown at 17, 18, 25A, and 26A. The purpose of each of these magnets will be further explained. Gaseous hydrogen (or other ionizable gas) leaving the separator 16 can be directed through a manifold 19 to a gas injection control system 14, and then into a plasma generator 20.

The plasma generator 20 in this invention is preferably a helicon plasma generator. Helicon plasma generators are known in the art and typically include an antenna (not shown separately in FIG. 1) disposed near but not in contact with the central chamber of the generator 20. Radio frequency (RF) power at the so-called "helicon frequency" is passed through the antenna (not shown) to excite electrons on the gas atoms in the generator 20. The shape and type of the antenna are not critical to the operation of the plasma generator 20, as long as the antenna (not shown) is formed and preferably oriented so that the electric field imposed on the gas in the generator is polarized in a direction which maximizes ionization of the gas flowing within the generator 20. The preferred orientation is known in the art of helicon discharge generators. The generator 20 includes a first magnet shown generally at 17 which imposes a DC magnetic field upon the gas atoms in the generator 20. The first magnet 17 is preferably polarized along the longitudinal axis of the generator 20. RF power applied to the antenna (not shown) at the helicon frequency of the gas in the generator 20 will excite the gas atoms to an ionized state. As previously explained, the first magnet 17 can be a superconducting electromagnet cooled by liquid hydrogen drawn from the separator 16. In this embodiment the first magnet 17 can be a superconducting coil wound around the longitudinal axis of the generator 20. The RF power used to energize the antennas (not shown) can be supplied by an RF power supply 22. The RF power supply 22, as well as power supplies for other systems associated with the engine 10 and a vehicle (not shown) propelled by the engine 10, can be connected to a power conditioner 23. The power conditioner 23 directs and conditions electrical power from a prime source (not shown), such as a nuclear/thermal generator, solar panels, hydrogen/oxygen fuel cells or the like, to the power supply 22. An advantage of using a helicon generator to generate plasma is that no electrodes are in contact with the gas or plasma, thereby reducing the possibility of erosion, as would be more typical of electrostatic plasma generators. Another advantage of using a helicon generator is that the efficiency of helicon generators tends to be high as compared to electrostatic plasma generators. Use of the available supply of ionizable gas will be more efficient and economical when the efficiency of the generator 20 is high.

In this embodiment of the invention, the engine 10 can be used with an outer space travelling vehicle (not shown). The engine 10 as shown in FIG. 1 will in this case be exposed to the vacuum of outer space. An advantage of this embodiment of the invention when operated in outer space is that nonionized gas remaining in the generator 20 after helicon excitation will be substantially unaffected by the magnetic field imposed by the first magnet 17. The nonionized gas will therefore be readily extracted from the generator 20 by the ambient space vacuum. Ionized gas and free electrons, however, will be constrained by the magnetic field imposed by the first magnet 17 and will travel substantially axially away from the gas inlet of the generator 20. By using space vacuum to remove nonionized gas from the generator, the amount of nonionized gas entering a heater 25, which will be further explained, can be substantially reduced. The efficiency of the heater 25 can be substantially increased by reducing the amount of nonionized gas entering the heater 25.

Another important feature of this embodiment of the invention is the physical separation of the plasma generation/ionization chamber 20 and the plasma heater 25. Such separation isolates any unwanted residual neutral particles, which may result from incomplete ionization of the injected gas, from the plasma heater chamber 25. By isolating the residual neutral particles from the heater 25, the charge exchange reaction between cold (unheated) neutral particles and hot (heated) ions is minimized. The charge exchange reaction tends to remove energy from the plasma in the form of hot neutral particles which, unaffected by the magnetic field imposed by a third magnet 25A forming part of the heater 25, impinge on the wall of a chamber 25B inside the third magnet 25A, thereby heating the wall of the chamber 25B and causing material erosion. The unwanted neutral particles in the ionization chamber 20 can, as previously explained, be naturally pumped away radially by the ambient vacuum of space.

Plasma formed in the generator 20 can be directed out of the generator 20 substantially along the longitudinal axis of the engine 10 by a second magnet 18 which imposes an axially polarized DC magnetic field on the plasma. As is the case for the first magnet 17, the second magnet 18 can be a superconducting magnet cooled by liquid hydrogen drawn from the separator 16 or drawn directly from the supply 12.

As the plasma leaves the generator 20, it moves into the heater 25 which in this embodiment can be an ion cyclotron resonance (ICR) chamber. The ICR chamber includes a central chamber 25B, an antenna array 21 connected to the RF power supply 22, and includes the third magnet 25A disposed around the chamber 25B. The configuration of the antenna array 21 is not critical to the invention, but the antenna array 21 should be formed and oriented to impose an electromagnetic field on the ionized gas in the chamber 25B which will excite ion cyclotron resonance on the ionized gas in the chamber 25B. The third magnet 25A, can also be a hydrogen-cooled superconducting magnet. The third magnet 25A can include radiative cooling panels 13 to extract still more heat from the magnet 25A to help assure that the magnet temperatures stay within the range required for superconduction. The third magnet 25A imparts an axially polarized DC magnetic field on the plasma in the chamber 25B. When RF power is applied to the antenna array 21 at the ion cyclotron frequency of the plasma in the chamber 25B, the plasma particles gain velocity while travelling in a substantially helical pattern around the axis of the chamber 25B. The overall movement of the plasma in the chamber 25B is substantially axial in a direction away from the generator 20 and along the direction of the radially diverging magnetic field induced by the third magnet 25A. The RF power supply 22 is shown in FIG. 1 and is described herein as being connected to antennas in both the generator 20 and the heater 25 for simplicity of the drawing and accompanying description of this embodiment of the invention. The actual configuration of RF power supply is not critical to the invention. It is only necessary to have available a supply of RF power at the helicon frequency for coupling to the generator 20 and a supply of RF power at the ion cyclotron frequency for coupling to the heater 25. Two separate, single-frequency RF power supplies will function correctly for purposes of this embodiment of the invention.

It has been determined that helically travelling plasma particles, consisting of both electrons and ionized gas atoms, will leave the static magnetic field imparted to the chamber 25B at very high axial velocity when dispersed in a radially diverging magnetic field such as that which is present at the axial ends of the third magnet 25A. The radially diverging magnetic field from the third magnet 25A, therefore, acts as a "magnetic nozzle" for the discharging plasma from the chamber 25B. A particular advantage of this invention is that both the ionized gas particles and the free electrons in the plasma are discharged from the end of the chamber 25B at substantially the same rate. Therefore, there is no need to electrostatically neutralize the discharging plasma as is required for prior art plasma discharge engines.

The excited plasma which travels toward the discharge end of the chamber 25B, in a particular embodiment of the invention can be further constrained through a magnetic choke 26 defined by the fourth magnet 26A. The fourth magnet 26A can also be a hydrogen cooled superconducting magnet which imposes an axially polarized DC magnetic field on the plasma. The effective magnetic aperture provided by the choke coil 26, as compared to that of the chamber 25B could range from zero to any appropriate value selected so that some of the plasma exiting the chamber 25B through the choke 26 is reflected back to the inlet side of the chamber 25B. Reflected plasma particles passing once again through the RF resonance region in the chamber 25B will be additionally excited by the RF electromagnetic field imposed by the antenna array 21. A power conditioning/supply and control circuit 27, which can include the DC power source for fourth magnet 26A, can be selectably operated to vary the amplitude of the DC magnetic field generated by the fourth magnet 26A. Varying the amplitude of the field generated by the fourth magnet 26A has the effect of varying the "aperture" of the choke 26, which will in turn vary the amount of plasma reflection and resultant reexcitation of the reflected plasma in the heater 25. By reexciting the plasma in the heater 25, its discharge velocity, and thereby the specific impulse of the engine 10, can be increased. The choke 26 provides improvement to the operation of the engine 10 by selectively increasing the specific impulse of the engine 10. However, it should be clearly understood that the engine 10 will work without the choke 26.

Plasma which leaves the chamber 25B, whether through the choke 26 or directly if the choke 26 is omitted, can be further manipulated to improve the overall efficiency of the engine 10 by passing the discharged plasma through an array of "ripple coils" 29 located axially "downstream" of the heater 25 (or downstream of the choke 26 if used). The ripple coil array 29 can be connected to an AC power supply, which in this embodiment can form part of the control circuit 27 used to selectively operate the fourth magnet 26A. The ripple coils 29 can be one or more individual coils, or a solenoid wound around the axis of the engine 10 downstream from the heater 25. The ripple coils 29 should be oriented to induce a substantially axially polarized AC magnetic field on the plasma leaving the engine 10.

The amplitude of the AC magnetic field induced by the ripple coils 29 is preferably large enough to affect the outer boundary of the plasma leaving the engine 10 but is small enough to avoid penetrating all of the plasma exhaust leaving the engine 10. The AC magnetic field has the effect of efficiently separating the discharging plasma from the static magnetic field of the third magnet 25A by inducing plasma instabilities and turbulence in the outer layers of the discharging plasma column. The AC magnetic field induced by the ripple coils 29 will typically be weaker in peak amplitude than the DC field in the vicinity of the heater 25 but will be strong enough to affect the plasma separation from the DC magnetic field.

Liquefied hydrogen (or other ionizable gas) drawn from the supply tank 12 also can be pumped by a second pump 24 through appropriate control valving and conditioning equipment, shown generally at 28, to the discharge end 10A of the engine 10. This gas is pumped into the plasma exhaust in neutral (nonionized) form. The neutral gas is discharged into the plasma substantially on the radially outermost part of the plasma exhaust column in the form of an annular ring substantially coaxial with the plasma column. Discharging the ionizable gas into the plasma leaving the engine 10 through the discharge end 10A acts as a "plasma afterburner" to provide very high thrust from the engine 10 when needed for particular aspects of operation of the vehicle (not shown). Another function of this coaxial, annular high speed neutral gas jet is to induce a high number of particle collisions within the outer layers of the discharging plasma column, which will tend to detach the plasma from the radially diverging magnetic field through the process of collisional diffusion. Since this "afterburner" mode would be used preferentially when the engine 10 operates in the low specific impulse (high thrust) mode, as will be further explained, at a time when the plasma column divergence will be greater, the neutral gas annulus will also form a boundary layer which will protect any surrounding material structure near the rocket nozzle, such as parts of the vehicle (not shown). The rate of injection of the neutral gas can be selected for desired thrust enhancement, or alternatively can be selected for protecting the structure of the vehicle.

An advantageous aspect of this invention is that the thrust and specific impulse output of the engine 10 can be selectively controlled by directing selected portions of the total output of the RF power supply 22 to the generator 20 antenna (not shown), with the remainder of the total RF power output directed to the cyclotron resonance antenna array 21. For a fixed total amount of RF power directed from the supply 22, the mass of plasma and its discharge velocity can be controlled by appropriate selection of the fraction of RF power directed to each of the antenna arrays. As is known in the art, the specific impulse of the engine 10 is related to the velocity at which the plasma is discharged from the engine 10. The thrust of the engine 10 is related to the rate at which mass of plasma is discharged from the engine 10 as well as its discharge velocity. The engine 10 of the invention can provide low thrust at very high specific impulse for long flights (such as interplanetary missions) by increasing the amount of RF energy directed into the heater 25. Since the amount of energy available in a space vehicle is essentially fixed, the ability to selectively control the specific impulse of the engine as well as the thrust results in efficient use of the fixed supply of power on board the space vehicle (not shown) propelled by the engine 10. Low thrust over an extended period of time, as is understood by those skilled in the art, can provide very high velocity when the vehicle travels in a substantially frictionless environment such as outer space, so as to reduce overall travel time for the selected journey. Conversely, when the space vehicle is to escape planetary orbit, or is to reenter planetary orbit or atmosphere, the RF power can be substantially redirected to the generator 20 so as to provide high thrust for such escape or reentry.

In a typical mission application of this invention, as for a human interplanetary mission, the thrust and specific impulse variation will follow a continuous optimum schedule, so as to achieve the shortest trip time with reasonable payload. In another application of this invention, such as in a robotic cargo mission, the very high specific impulse could be used at the expense of thrust over most of the trip to achieve a very high payload capability but with a longer trip time. In still another application of this invention, the thrust and specific impulse variation could be used to achieve a mission abort capability which would enable a human crew to still return to Earth after experiencing a degradation of the propulsion system, such as the loss of a fraction of the on board propellant (ionizable gas in supply 12 in FIG. 1). Variable thrust and specific impulse engines such as described in this invention can also provide advantageous capabilities in attitude control of a space vehicle. For example, the high thrust mode can be used to rapidly move and point very massive spacecraft, while the high specific impulse mode can provide extremely accurate pointing of the spacecraft with the same engine assembly.

In addition, operation of the magnetic choke 26 and the addition of neutral gas in the afterburner mode in 10A can further control the thrust and specific impulse.

Figure 2:
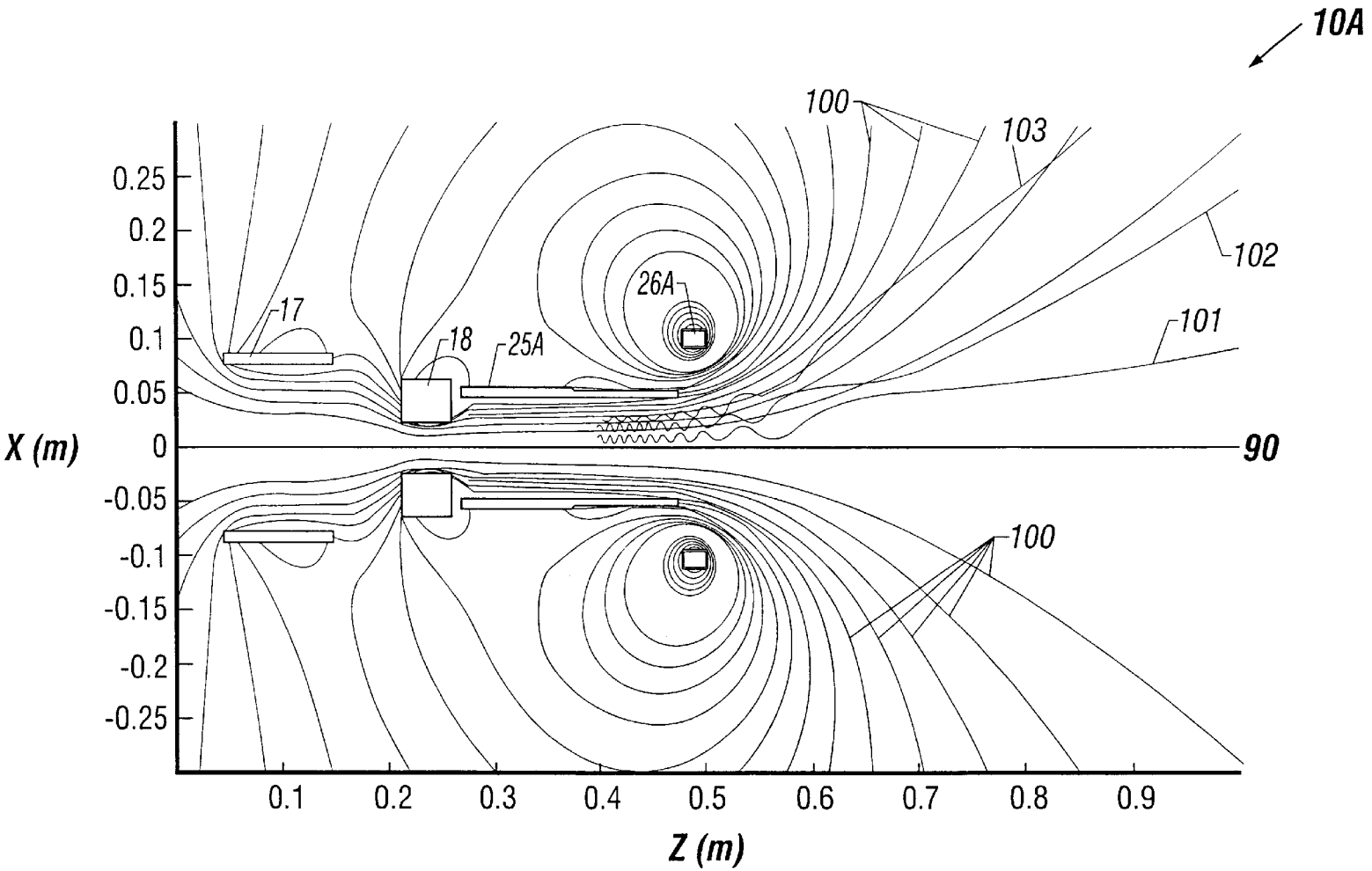
FIG. 2 shows a graph of magnetic field distribution and exhaust particle trajectories for the example embodiment of the engine shown in FIG. 1.

FIG. 2 shows the expected distribution of magnetic fields and particle trajectories for the example engine shown in FIG. 1. In FIG. 2, the magnet for the plasma generator is shown at 17, the second magnet is shown at 18, the third magnet is shown at 25A and the fourth magnet (when used) is shown at 26A. Although the magnets are described herein as separate magnets, it should be understood that the individual magnets need not be physically separated as individual structures. An alternate embodiment of the plasma generator magnet 17, heater magnet 25A and choke magnet 26A, for example, can be in the form of a single continuous superconducting solenoid where the number of axial windings is tailored to provide the required magnetic field distribution. As can be seen in FIG. 2, the discharge end 10A of the engine has a magnetic field which diverges radially from the axis 90 of the engine. Typical distribution of the magnetic field on the discharge side 10A is shown by field lines 100. Particles travelling along the expected helical paths in the heater (25 in FIG. 1) will leave the engine along trajectories substantially as shown in FIG. 2, for example, at 101, 102 and 103. The radial divergence of a particular particle trajectory will depend on, among other things, the initial radius of the helical path taken by the particular particle in the heater (25 in FIG. 1) and therefore, the plasma diameter compared to that of the diameter of the heater chamber (25B in FIG. 1) is small enough to provide minimum divergence while being big enough for effective utilization of the heater chamber (25B in FIG. 1) volume.

The embodiments of the invention described herein are only for purposes of illustration and understanding of the invention. Those skilled in the art will be able to devise other embodiments of this invention which do not depart from the spirit of the invention as disclosed herein. Accordingly, the invention shall be limited in scope only by the attached claims.

What is claimed is:

1. An engine, comprising:

a plasma generator having a controllable output;

a controllable heater located downstream of an outlet of said plasma generator, arranged to selectably heat said plasma; and a nozzle operatively coupled to an outlet of said heater, said plasma being discharged through said nozzle to provide thrust.

2. The engine as defined in claim 1, wherein said plasma generator comprises a helicon generator.

3. The engine defined in claim 1, wherein said plasma generator is externally vented to vacuum so that nonionized gas particles in said plasma generator are extracted by said vacuum and substantially only ionized particles enter said heater.

4. The engine as defined in claim 1, wherein said plasma generator is coupled to a hydrogen source.

5. The engine as defined in claim 4, wherein said hydrogen source further comprises a source of liquid hydrogen.

6. The engine as defined in claim 1 wherein said controllable heater comprises an ion cyclotron resonator.

7. The engine as defined in claim 1, wherein said nozzle comprises a diverging magnetic field.

8. The engine as defined in claim 7 wherein said diverging magnetic field is induced by a magnet forming part of said heater.

9. The engine as defined in claim 7, wherein said diverging magnetic field is induced by a superconducting electromagnet.

10. The engine as defined in claim 9 wherein said superconducting electromagnet is cooled by a liquid having a temperature below a superconducting temperature of said electromagnet.

11. The engine as defined in claim 10 wherein said liquid comprises a liquid phase of a gas to be ionized in said plasma generator.

12. The engine as defined in claim 1, further comprising a control circuit operatively connected to said plasma generator and said heater, said control circuit arranged to selectively direct portions of a total radio frequency power output from a source to a first antenna disposed in said plasma generator and to a second antenna disposed in said controllable heater, said control circuit operable to direct selected portions of said total power output to said first antenna and to said second antenna so that a specific impulse and a thrust output of said engine can be selectively controlled.

13. The engine as defined in claim 1, further comprising an alternating magnetic field source disposed on an exhaust side of said engine for separating particles exiting from said engine from a diverging DC magnetic field disposed on said exhaust side of said engine.

14. The engine as defined in claim 1, further comprising a controllable source of nonionized gas to be discharged in an ionized exhaust from said engine, said controllable source of nonionized gas arranged to inject said nonionized gas in a substantially annular ring surrounding said ionized exhaust.

15. The engine as defined in claim 14 wherein said controllable source comprises means for controlling a rate of injection of said nonionized gas to control a thrust of said engine.

16. The engine as defined in claim 14 wherein said controllable source comprises means for controlling a rate of injection of said nonionized gas to increase efficiency of separation of said ionized exhaust from a magnetic field present on an exhaust side of said engine.

17. The engine as defined in claim 14 wherein said controllable source comprises means for controlling a rate of injection of said nonionized gas to provide a protective boundary layer between a vehicle structure proximate to said ionized exhaust.

18. The engine as defined in claim 1, further comprising a selectably operable choke disposed between a discharge side of said heater and said nozzle, said choke arranged to selectively reflect selected fractions of an exhaust from said heater back through said heater to further increase the temperature of said reflected plasma.

19. The engine as defined in claim 18; wherein said choke comprises an electromagnet arranged to impart a selectable amplitude DC magnetic field to an exhaust of said heater.

20. A method for propelling a vehicle, comprising:

generating a plasma;

subsequently heating said plasma, and discharging said heated plasma through a nozzle.

21. The method as defined in claim 20 wherein said generating comprises imparting a first radio frequency electromagnetic field to a gas disposed in an axially polarized DC magnetic field.

22. The method as defined in claim 21 wherein said first radio frequency electromagnetic field has a frequency substantially equal to a helicon frequency of said gas.

23. The method as defined in claim 20, wherein said heating comprises imparting a second radio frequency electromagnetic field to said plasma in a chamber separated from a location where said generating is performed, said chamber disposed in an axially polarized DC magnetic field.

24. The method as defined in claim 23 wherein said second radio frequency electromagnetic field has a frequency substantially equal to an ion cyclotron frequency of said plasma.

25. The method as defined in claim 20 wherein said generating is performed in an environment vented substantially to a vacuum, so that nonionized particles in said gas are extracted from said plasma by said vacuum, and ionized particles in said plasma are constrained by said DC magnetic field.

26. The method as defined in claim 20, wherein said nozzle comprises a radially diverging magnetic field, so that both ions and electrons in said plasma are discharged after said heating.

27. The method as defined in claim 20, further comprising returning a selected portion of said heated plasma to be heated again prior to said discharging, so that a velocity of said plasma during said discharging is increased.

28. The method as defined in claim 20, further comprising imparting an alternating electromagnetic field to said plasma after said discharging whereby said plasma is separated from said nozzle.

29. The method as defined in claim 20, further comprising injecting nonionized gas into said plasma after said discharging, said injecting performed at a rate selected to increase a thrust of said discharged heated plasma.

30. The method as defined in claim 20, further comprising injecting nonionized gas into said plasma after said discharging substantially in the form of an annular ring surrounding said heated discharged plasma, said injecting performed at a rate selected to increase efficiency of separation of said discharged heated plasma from a diverging magnetic field forming said nozzle.

31. The method as defined in claim 20, further comprising injecting nonionized gas into said heated discharged plasma in the form of an annular ring surrounding said heated discharged plasma, said injecting performed at a rate selected to protect vehicular structures present proximate to said discharged heated plasma.

32. The method as defined in claim 20, further comprising directing a selected fraction of a total electrical power to said generating, and a remainder of said total electrical power to said heating so as to selectively vary a thrust and a specific impulse of propulsion.

33. A method for adjusting an attitude of a vehicle, comprising:

generating a plasma;

heating said plasma;

discharging said heated plasma through a nozzle in a direction selected to change said attitude along a desired trajectory; and directing a selected fraction of a total electrical power to said generating, and a remainder of said total electrical power to said heating so that a thrust and a specific impulse of said discharging is selectively varied.

34. The method as defined in claim 33 wherein said thrust is selected to be high when large attitude changes are required, and said specific impulse is selected to be high when precise attitude adjustments are required.

35. The method as defined in claim 33, further comprising returning a selected portion of said heated plasma to be heated again prior to said discharging, so that a velocity of said plasma during said discharging is increased, thereby increasing further a specific impulse of said propulsion.

36. The method as defined in claim 33 wherein said thrust is selected to be high when rapid attitude changes are required.

37. The method as defined in claim 33, further comprising injecting nonionized gas into said plasma after said discharging, said injecting performed at a rate selected to increase a thrust of said discharged heated plasma when large attitude changes are required.

38. The method as defined in claim 33, further comprising injecting nonionized gas into said plasma after said discharging, said injecting performed at a rate selected to increase a thrust of said discharged heated plasma when rapid attitude changes are required.

39. The method as defined in claim 33, further comprising injecting nonionized gas into said plasma after said discharging substantially in the form of an annular ring surrounding said heated discharged plasma, said injecting performed at a rate selected to increase efficiency of separation of said discharged heated plasma from a magnetic field disposed on an exhaust side of a heater used to heat said plasma.

40. The method as defined in claim 33, further comprising injecting nonionized gas into said heated discharged plasma in the form of an annular ring surrounding said heated discharged plasma, said injecting performed at a rate selected to protect vehicular structures present proximate to said discharged heated plasma.

41. The method as defined in claim 33 wherein said generating is performed in an environment vented substantially to a vacuum, so that nonionized particles in said gas are extracted from said plasma by said vacuum, and ionized particles in said plasma are constrained by said DC magnetic field.

42. The method as defined in claim 33, wherein said discharging comprises exhausting said heated plasma through a radially diverging magnetic field, so that both ions and electrons in said plasma are discharged after said heating.

43. The method as defined in claim 33, further comprising returning a selected portion of said heated plasma to be heated again prior to said discharging, so that a velocity of said plasma during said discharging is increased, thereby increasing a specific impulse of propulsion when very precise attitude adjustments are required.

* * * * *